United States Patent [19]

Leyrat et al.

[11] 4,077,529

[45] Mar. 7, 1978

[54] EXCAVATOR BUCKET AND RIPPER TOOTH ASSEMBLY

[75] Inventors: Pierre Jean Leyrat, Trilport; Daniel Diony Baconet, Stains, both of France

[73] Assignee: Societe Anonyme: Poclain, Le-Plessis-Belleville, France

[21] Appl. No.: 703,320

[22] Filed: Jul. 8, 1976

[30] Foreign Application Priority Data

Aug. 1, 1975 France ..... 75 24170

[51] Int. Cl.[2] ..... E02F 3/81

[52] U.S. Cl. ..... 214/145 R; 37/117.5; 37/DIG. 3

[58] Field of Search ..... 214/138 R, 145 R, 145 A; 37/117.5, 141 R, 141 T, DIG. 3, DIG. 12; 299/67

[56] References Cited

U.S. PATENT DOCUMENTS

| | | | |
|---|---|---|---|
| 3,061,123 | 10/1962 | Rogers | 214/145 R |
| 3,512,665 | 5/1970 | Westendorf | 214/145 A |
| 3,778,111 | 12/1973 | Ciofani | 37/117.5 X |
| 3,854,608 | 12/1974 | Arnold | 37/117.5 X |
| 3,959,900 | 6/1976 | Luck | 37/117.5 |

*Primary Examiner*—L. J. Paperner

*Attorney, Agent, or Firm*—Lewis H. Eslinger

[57] ABSTRACT

Public works machine comprising a bucket mounted to pivot on the end of a boom, a device for adjusting the relative position of said bucket with respect to said boom, a ripper tooth, which is mounted to pivot on the end of the boom, while said position-adjusting device is coupled between the boom and the tooth, two selective immobilization devices, one for immobilizing the bucket with respect to the boom in a configuration where said bucket is not in operation, in which the penetrating element of this bucket is orientated towards the boom and disposed near said latter, the other for immobilizing the bucket with respect to the tooth in a configuration where said tooth is not in operation, in which said tooth is joined to the outer face of the bottom of the bucket, the distance separating the end of the tooth from the pivot axis being at the most equal to that separating the penetrating element of the bucket from said pivot axis. One application of the present invention is the production of a public works machine which is satisfactorily efficient for digging and breaking up works.

4 Claims, 5 Drawing Figures

EXCAVATOR BUCKET AND RIPPER TOOTH ASSEMBLY

The present invention relates to a public works machine comprising a bucket and a ripper tooth.

Back-hoe buckets are already known, on the rear face of the bottom of which are fixed one or more ripper teeth. In the most improved of these buckets, the tooth may pivot on the bucket and its end may be placed in a position far from the bucket to allow said tooth to operate. The adjustment of the position of the tooth with respect to the bucket is, in any case, fixed during the time that said tooth is in operation.

It is an object of the present invention to render the adjustment of the position of the tooth continuously and easily controllable whilst said tooth is in operation.

To this end, the present invention relates to a public works machine comprising a bucket, mounted to pivot on the end of a boom, a device for adjusting the relative position of said bucket with respect to said boom and a ripper tooth.

This ripper tooth is mounted to pivot on the end of the boom about the pivot axis of the bucket, whilst said position-adjusting device is coupled between the boom and the tooth, and two selective immobilisation devices are provided, one of which enables the bucket to be immobilised with respect to the boom in a configuration where said bucket is not in operation, in which the penetrating element of this bucket is orientated towards the boom and disposed near said latter, and the other of which enables the bucket to be immobilsed with respect to the tooth in a configuration where said tooth is not in operation, in which said tooth is joined to the outer face of the bottom of the bucket, the distance separating the end of the tooth from the pivot axis being, in addition, at the most equal to that separating the penetrating element of the bucket from said pivot axis.

The two immobilising devices are preferably constituted by at least one stop movably mounted on the bucket, and by at least two orifices, one of which is made in the boom, the other in the tooth, into which said stop is inserted in the said two configurations, each orifice corresponding to a determined configuration.

The stop is advantageously coupled to the mobile member of a single-acting jack and to a spring pushing it into a prominent position, this stop being, on the contrary, placed in a withdrawn position under the effect of the pressure of a pressurised fluid contained in the driving chamber of the jack.

The invention will be more readily understood on reading the following description with reference to the accompanying drawings, in which.

Figure 1:
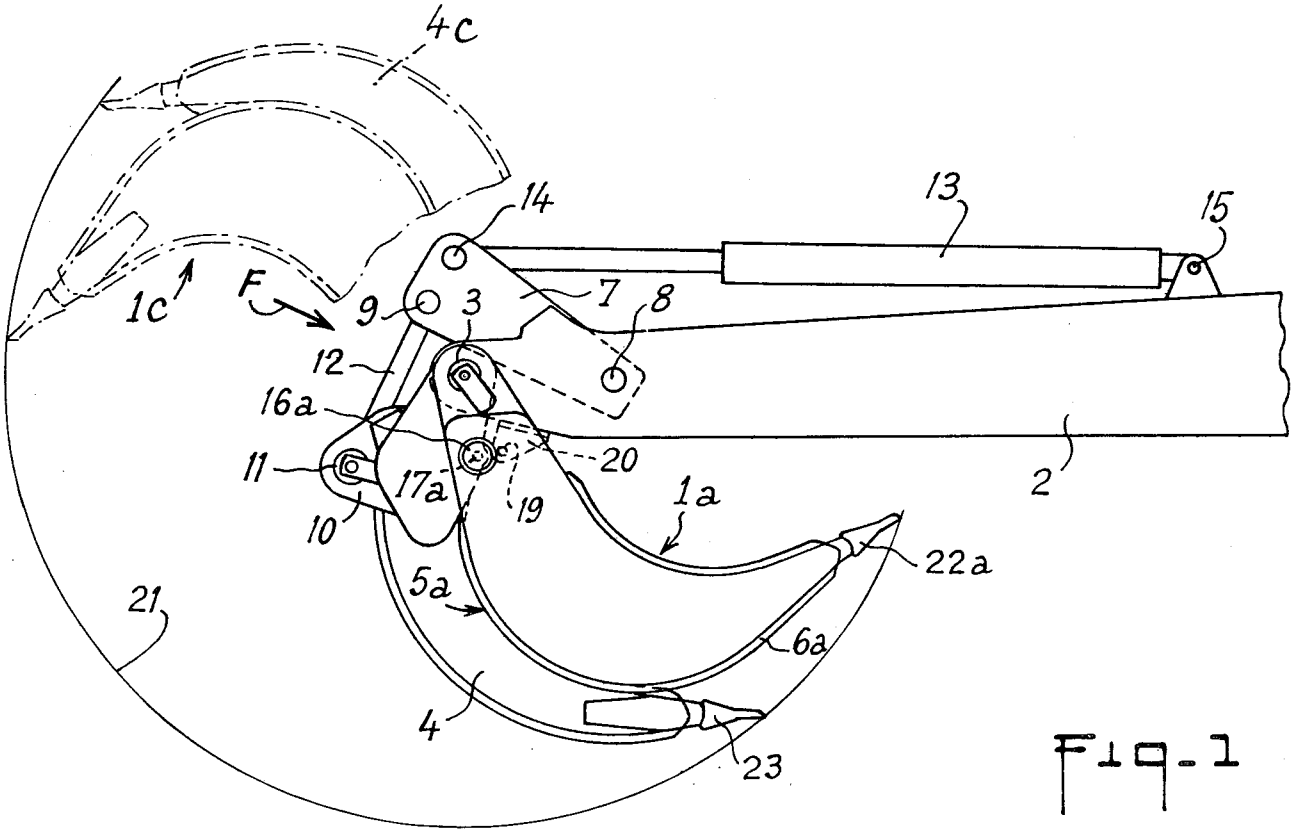
FIG. 1 is a view in elevation of an assembly according to the invention, in the configuration in which the bucket is in operation and the ripper tooth is not in operation.

Referring now to the drawings, a bucket 1*a* is mounted to pivot at the end of a boom 2, about an axis 3. A ripper tooth 4 is also mounted to pivot about the axis 3 and is, in the present case, joined to the rear face 5*a* of the bottom 6*a* of the bucket.

A rocking lever 7 is articulated to the boom 2 about an axis 8. The ends of a connecting rod 12 are articulated on the one hand to the rocking lever 7 about an axis 9, on the other hand to lugs 10, with which the tooth 4 is provided, about an axis 11. A double-acting hydraulic jack 13 is coupled via pins 14 and 15, on the one hand to the rocking lever 7 and on the other hand to the boom 2.

Figure 2:
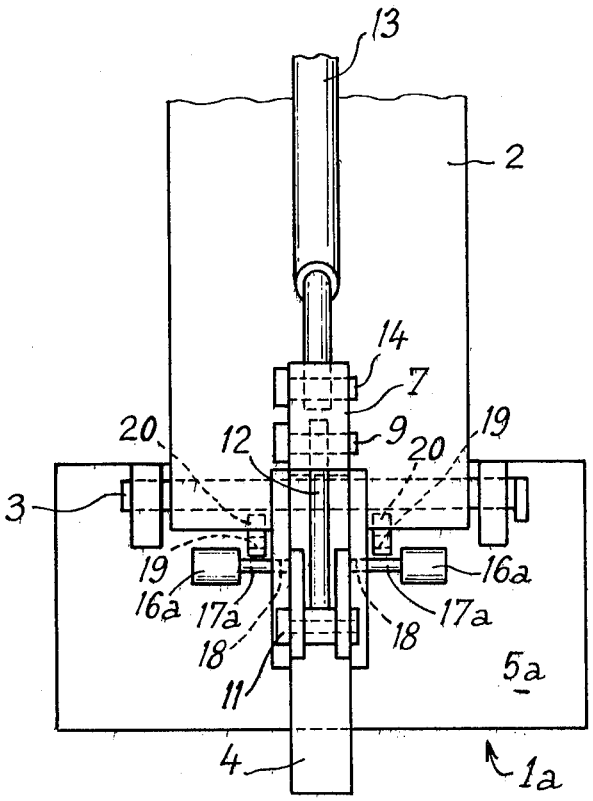
FIG. 2 is a view in the direction of arrow F of FIG. 1.

It wil be noted that the bodies 16*a* of two small jacks are fixed to the rear face 5*a* of the bucket, whilst a mobile stop 17*a* fast with the piston of each jack is inserted into an orficie 18, with which the tooth 4 is provided. In the configuration of FIGS. 1 and 2, the stops 17*a* are therefore disposed out of orifices 19 made in lugs 20 fast with the boom 2.

To be noted are the second positions, shown at 4*c* and 1*c*, of the ripper tooth and of the bucket respectively, resulting from an adjustment of position made by means of the jack 13, as well as an arc 21 centered on the pivot axis 3 and representing the (common) path that the teeth 22*a* of bucket 1*a* and the end 23 of the ripper tooth 4 may follow.

Figure 4:
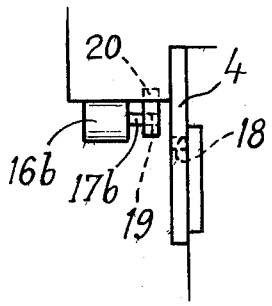
FIG. 4 shows a detailed view of part of the assembly of FIG. 3 in the direction of arrow H of this Figure.
Figure 3:
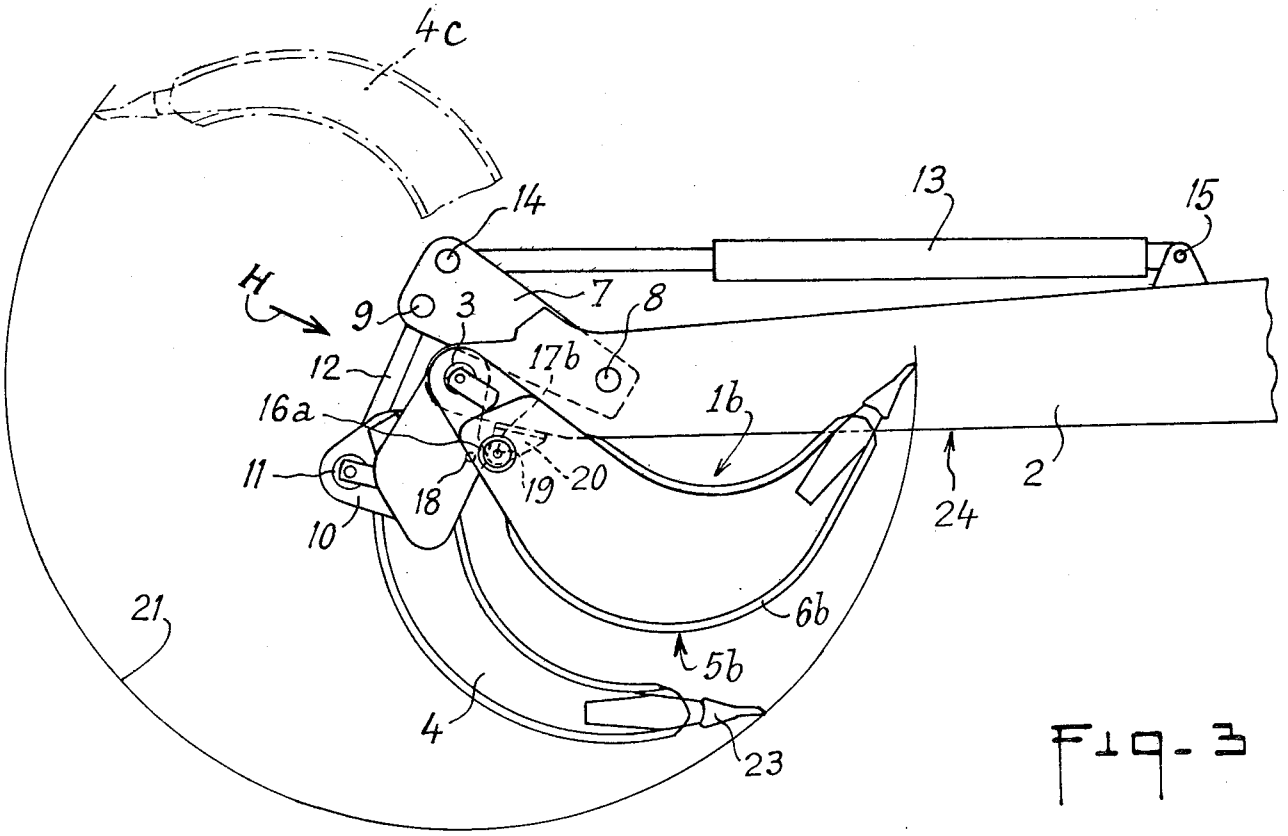
FIG. 3 is a view in elevation of the assembly of FIG. 1 in a second configuration, in which the bucket is not in operation but the ripper tooth is on the contrary in operation.

With reference to FIGS. 3 and 4, the tooth 4 and boom 2 have unchanged relative positions with respect to the configuration of FIGS. 1 and 2. On the other hand, the bucket is now disposed at 1*b*, under the lower face 24 of the boom 2. The tooth 4 is detached from the rear face 5*b* of the bottom 6*b* of the bucket. This bucket 1*b* is, moreover, maintained in its position 1*b* by means of stops 17*b* which are inserted into the orifices 19 in the lugs 20, the bodies of the small jacks for controlling said stops being disposed at 16*b*.

Figure 5:
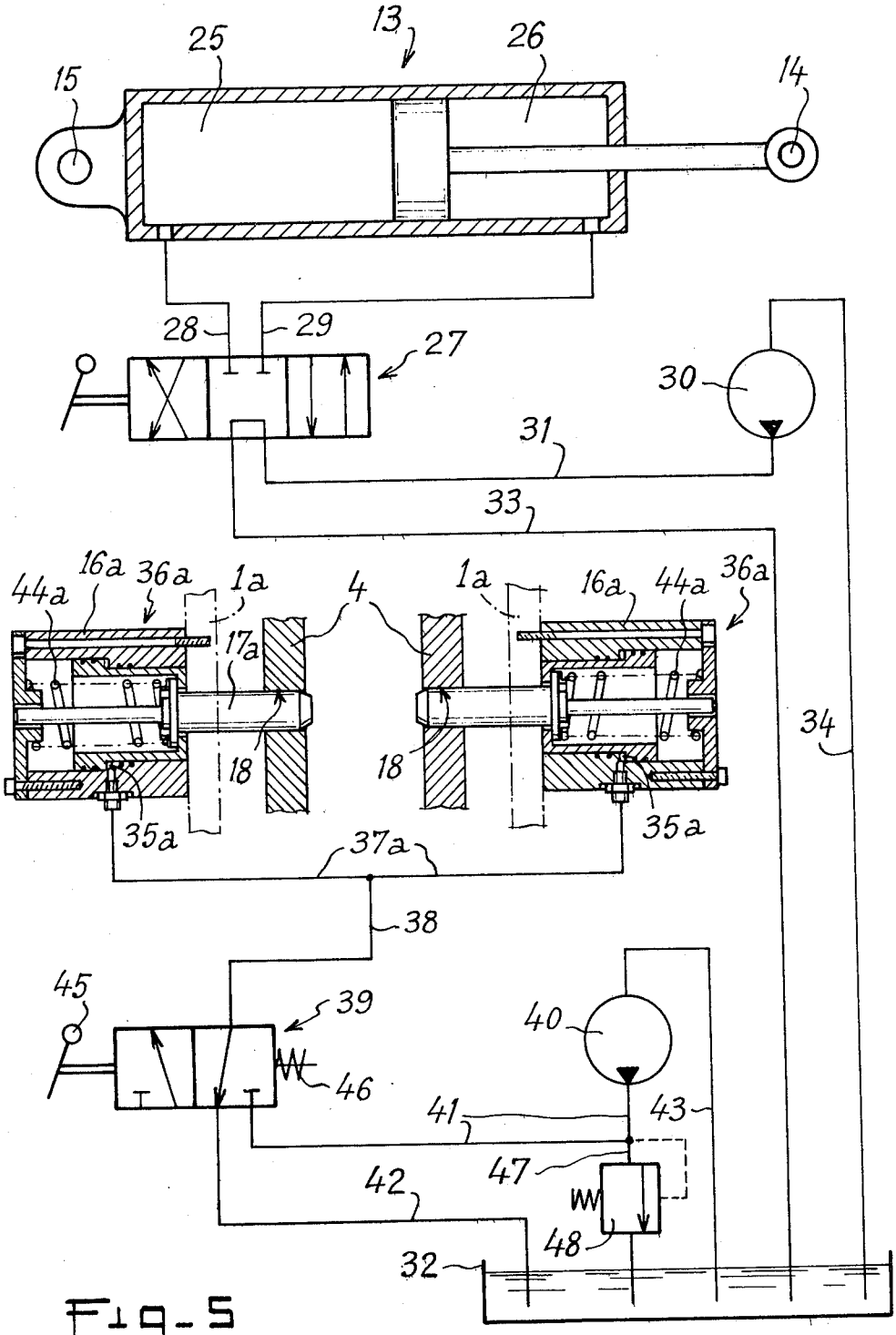
FIG. 5 shows the control circuit of the assembly shown in FIGS. 1 to 4.

FIG. 5 shows the control circuit of the device of FIG. 1.

The chambers 25 and 26 of jack 13 are connected to a three-way distributor 27 via pipes 28 and 29. This distributor 27 is itself connected to a pump 30 via the delivery pipe 31 of this pump and to a tank 32 via a pipe 33. The suction pipe 34 of the pump 30 is itself connected to tank 32.

The driving chambers 35*a* of the jacks 36*a* of body 16*a* are connected via pipes 37*a* to a pipe 38 connected to a two-way distributor 39. This distributor 39 is itself connected to a pump 40 via the delivery pipe 41 of this pump and to the tank 32 via a pipe 42. The suction pipe 43 of the pump 40 connects it to tank 32. A pipe 47 connects the pipe 41 to tank 32, a calibrated discharge valve 48 being disposed in this pipe 47.

In each body 16*a*, a spring 44*a* pushes the stops 17*a* into orifices 18, against the pressurised fluid contained in the chambers 35*a*, whose effect provokes the removal of the stops 17*a* from the orifices 18.

The three positions of the distributor 27 correspond as follows:

the first position corresponds to the communications of pipes 31 and 29, and of pipes 28 and 33;

the second position corresponds to the communication of pipes 31 and 33, and to the obturations of pipes 28 and 29; and the third position corresponds to the communications of pipes 31 and 28, and of pipes 29 and 33.

The two positions of the distributor 39 correspond as follows:

the first position corresponds to the communication of pipes 38 and 42, and to the obturation of pipe 41; and, the second position corresponds to the communication of pipes 41 and 38, and to the obturation of pipe 42.

In the absence of force on the control lever 45 of the distributor 39, said latter is maintained in its first position by a spring 46.

The advantages of the device which has just been described will now be set forth.

Firstly, in the configuration of FIG. 1, there is a public works machine having a bucket 1*a* controlled in conventional manner by jack 13, rocking lever 7, connecting rod 12. In fact, in this case, the tooth 4 and bucket 1*a* reconstitute a monobloc assembly. To be noted is the fact that the end 23 of the tooth 4 does not exceed the circle 21 and consequently does not make a supplementary furrow in the hole dug out by the bucket 1*a* in the course of its pivoting about axis 3. Finally, of course, the device functions only because the tooth and the bucket 1*a* are mounted to pivot about the same axis 3.

When it proves necessary to break up the ground, which is too hard in places to be dug directly by the bucket 1*a*, said bucket is disposed at 1*b*. In this case, the tooth which is no longer fixed to the bucket by stops 17*b* may be manoeuvred independently and enable the necessary excavations to be carried out, particularly by action on the jack 13. In this operation, only tooth 4 has to be manoeuvred and not the heavy, cumbersome assembly of the bucket and tooth, as was the case of prior known devices.

It remains to be demonstrated how the bucket is immobilised either with respect to the boom 2 or with respect to the tooth 4.

To immobilise the bucket with respect to the boom 2, the distributor 39 is disposed in its second position. In this way, the stops 17*a* are extracted from the orifices 18. Then, the tooth 4 is separated from the bucket to bring it to 4*c*. Finally, the distributor 39 is replaced in its first position and, by applying the bucket against the ground, the stops 17*b* are brought in register with orifices 19 in which they penetrate under action of the springs 44*a*, effecting the desired immobilisation.

To immobilise the bucket with respect to tooth 4, said latter is placed in position 4, then the distributor 39 is placed in its second position. The stops 17*b* leave orifices 19 and release the bucket 1*b* which returns to 1*a*. The distributor 39 is then replaced in its first position, this causing the introduction of the stops 17*a* into the orifices 18 and enables the desired immobilisation to be obtained.

The invention, explained with reference to a back hoe bucket mounted to pivot on the end of the stick of a hydraulic shovel, is not limited to this application alone.

The bucket may more generally be mounted on the end not of a stick but of a boom.

Furthermore, the tooth may also be associated, no longer with a shovel bucket, but with a loader bucket.

Finally, in certain applications, this tooth could be located elsewhere than behind the bucket (to the side or in front, for example).

What is claimed is:

1. In a public works machine having a boom, a ripper tooth pivotally mounted on said boom for pivotal movement in a ground ripping direction, and a bucket pivotally mounted on said boom on the same pivot axis of rotation as said ripper tooth and being located in front of said ripper tooth in said ground ripping direction, said bucket having a scoop face facing said ground ripping direction, wherein the improvement comprises means operatively connected between said boom and said ripper tooth for pivoting the ripper tooth in said ripping direction and in a reverse direction from said ripping direction about its pivotal mounting on the boom, said bucket being freely pivotally mounted on the boom, and means for selectively locking said bucket in a first retracted position on said boom wherein said scoop face of the bucket is adjacent the boom in an inoperative position and a second active position on said ripper tooth wherein the ripping tooth is directly behind the bucket, whereby only said ripper tooth is pivoted by said pivoting means when said bucket is locked in its first position and both said ripper tooth and bucket is locked in its second position.

2. A public works machine as defined in claim 1 wherein said bucket has a ground penetrating element formed thereon including a free end and said ripper tooth has a free end; said ripper tooth having a predetermined dimension relative to said bucket selected such that the radial distance from the pivot axis of said ripping tooth to its free end is at most equal to the radial distance between said pivot axis and the free end of the penetrating element on the bucket whereby. In said second locked position of the bucket the ripper tooth trails the penetrating element of the bucket during pivotal movement in the ripping direction in a path of travel no further from said pivot axis than said penetrating element and does not interfere with digging of the ground by said bucket.

3. A public works machine as defined in claim 1 wherein said locking means includes a pair of apertures respectively formed in said boom and said tooth, a retractable stop mounted on said bucket and means for selectively extending and retracting said stop into and out of said apertures when said bucket is in its first or second positions.

4. A public works machine as defined in claim 3 wherein said means for selectively extending and retracting said stop comprises a single acting hydraulic jack including spring means therein for normally biasing said stop to its extended position.

* * * * *